US006782652B1

(12) United States Patent
Erickson

(10) Patent No.: US 6,782,652 B1
(45) Date of Patent: Aug. 31, 2004

(54) RAIL COVER FOR USE WITH A PICATINNY RAIL

(76) Inventor: Milton W. Erickson, N. 388 Riviera Ave., Merrillan, WI (US) 54754

( * ) Notice: Subject to any disclaimer, the term of this patent is extended or adjusted under 35 U.S.C. 154(b) by 0 days.

(21) Appl. No.: 10/461,804

(22) Filed: Jun. 13, 2003

(51) Int. Cl.[7] ..... F41G 1/38
(52) U.S. Cl. ..... 42/143; 42/124
(58) Field of Search ..... 42/96, 143, 124; 191/30; 74/558

(56) References Cited

U.S. PATENT DOCUMENTS

| | | | | | |
|---|---|---|---|---|---|
| 856,385 | A | * | 6/1907 | Baker | 191/30 |
| 1,888,552 | A | * | 11/1932 | Ford | 191/30 |
| 2,106,565 | A | * | 1/1938 | William | 191/30 |
| 3,303,293 | A | * | 2/1967 | Howell, Jr. | 191/23 A |
| 4,663,875 | A | * | 5/1987 | Tatro | 42/71.01 |
| 5,168,117 | A | * | 12/1992 | Anderson | 84/726 |
| 5,348,485 | A | * | 9/1994 | Briechle et al. | 439/110 |
| 5,373,926 | A | * | 12/1994 | Clarke et al. | 191/23 R |
| 6,203,200 | B1 | * | 3/2001 | Teramachi | 384/51 |
| 6,499,377 | B1 | * | 12/2002 | Schuler | 74/558 |

FOREIGN PATENT DOCUMENTS

JP 11-176409 * 11/1999

* cited by examiner

*Primary Examiner*—Stephen M. Johnson
(74) *Attorney, Agent, or Firm*—Michael A. Mann; Nexsen Pruet Adams Kleemeire, LLC

(57) ABSTRACT

A rail cover may be snapped on or off the side of Picatinny rail mounted to a weapon, such as a rifle. The rail cover protects the user from the teeth of the rail and from heat generated during repeated firing. The rail cover is readily installed or removed from the side, rather than being slipped over the end of the rail, by pressing it onto the rail or by prying it off the rail. The slightly flexible rail cover is preferably made of a polymer to which a rubberizing agent has been added and by forming grooves in its top surface. In addition to improving flexibility, the grooves also improve the user's grip on the rail cover. Locking tabs on the underside of the rail cover, dimensioned to fit in the grooves between adjacent teeth of the Picatinny rail, prevent axial movement of the rail cover when it is installed.

13 Claims, 3 Drawing Sheets

RAIL COVER FOR USE WITH A PICATINNY RAIL

CROSS-REFERENCE TO RELATED APPLICATIONS

None.

STATEMENT REGARDING FEDERALLY SPONSORED RESEARCH OR DEVELOPMENT

None.

REFERENCE TO A MICROFICHE APPENDIX

Not Applicable.

BACKGROUND OF THE INVENTION

A Picatinny rail is a structure incorporated into many military weapons. It is a rail attached typically to a rifle and that allows the securing of a variety of auxiliary weapons, such as grenade launchers or shotguns, and weapon-related devices, such as scopes and laser spotters to the rifle. In short, the rail enables the rifle to be turned into a multi-capability weapons platform. An example of such a rail for use in holding a number of different devices is shown and described in U.S. Pat. No. 5,590,484 for a Universal Mount for Rifle. The selection of components to be attached to a Picatinny rail and their precise arrangement on the rail is usually made just prior to a mission. Consequently, the weapon system will be configured ad hoc according to preferences of the individual who will be carrying the weapons platform.

The rail is a flattened bar having a major dimension much greater than its minor dimension and having a series of transverse grooves formed across the top of it. It has a cross section in the shape of a wide hexagon.

Devices that are to be attached to the rail either slide onto it from the end or are secured using clamps or clips. Once the selected attachments are secured to the Picatinny rail, there are a few exposed areas of the rail remaining. These are typically covered with a rail cover. The rail cover serves three purposes. It acts as a heat shield to protect the user's hand from the heat of the barrel. It provides a suitable surface to grip. Finally, it protects the rail from dirt, dust and damage.

The prior art rail cover is typically a thermoplastic panel that slides axially onto the rail from the end of the rail and is textured for grip, often by a series of transverse ribs. In order to prevent axial movement of the cover, a spring is included in the cover that snaps into one of the rail's grooves upon installation. By pressing on the spring, the user spreads it free of the groove for axial removal.

A problem with the prior art rail cover design is that it can only be applied by sliding it axially onto the end of the rail. Because the configuration of the auxiliary equipment may need to be changed quickly and often, and because the precise location of each component to be attached to the rail is not really known until the weapon system is assembled, it would be convenient if the rail cover, which comes in varying lengths, could be applied perpendicular to the rail without sliding it axially onto the end of the rail. Such a rail cover could then be applied where needed after the weapons system had been configured.

SUMMARY OF THE INVENTION

Briefly recited, the present invention is a rail cover that can be applied from the side, perpendicular to the rail surface. The rail cover is symmetric front to back and left to right, with a series of grooves running transversely across the back. The underside has a rail-gripping means undercut along both sides, with a pair of locating tabs that fit into a groove on the Picatinny rail to keep the rail cover from sliding axially.

A feature of the present invention is the combination of the undercut and the material of which the rail cover is made, namely, a polymer with a rubberizing agent for increased flexibility. This feature allows the present rail cover to be snapped onto and off of the rail quickly and easily. Furthermore, this feature also allows the rail cover to be molded in a very simple mold. No complex slide tooling or part ejection mechanism is required; at the completion of the molding cycle and opening of the mold, the finished rail cover may be easily unsnapped from the mold just as if the rail cover were to be removed from the rail. Tooling investment is minimized and product cycle times are reduced, allowing for higher productivity rates and significantly lower piece price.

The material itself is a feature of the present invention. Preferably it is a polymer with a rubberizing agent added. It is slightly flexible and dimensionally stable over a broad range of environmental conditions and over time.

The grooves transverse to the axis are yet another feature of the present invention. These grooves have several functions. First, they provide a more slip-resistant surface for gripping. Second, they reduce part weight and material usage without compromising overall part strength by leaving ribs between the grooves. Third, the grooves allow just enough flex so that a user may remove and install the rail cover on the rail.

The symmetric configuration of the rail cover is another important feature of the present invention; it may be put onto a rail in any orientation because of its symmetry. This "poke-yoke" feature allows for greater economies of scale in tool production by further reducing tool design and fabrication complexity, as well as simplifying manufacturing process gauges and part dimensional control. This feature also enables users to assemble the rail cover into the weapon system faster and with fewer rejected parts.

These and other features and their advantages will be apparent to those skilled in the art of designing and manufacturing weapons components from a careful reading of the Detailed Description of Preferred Embodiments, accompanied by the following drawings.

DETAILED DESCRIPTION OF PREFERRED EMBODIMENTS

Figure 1:
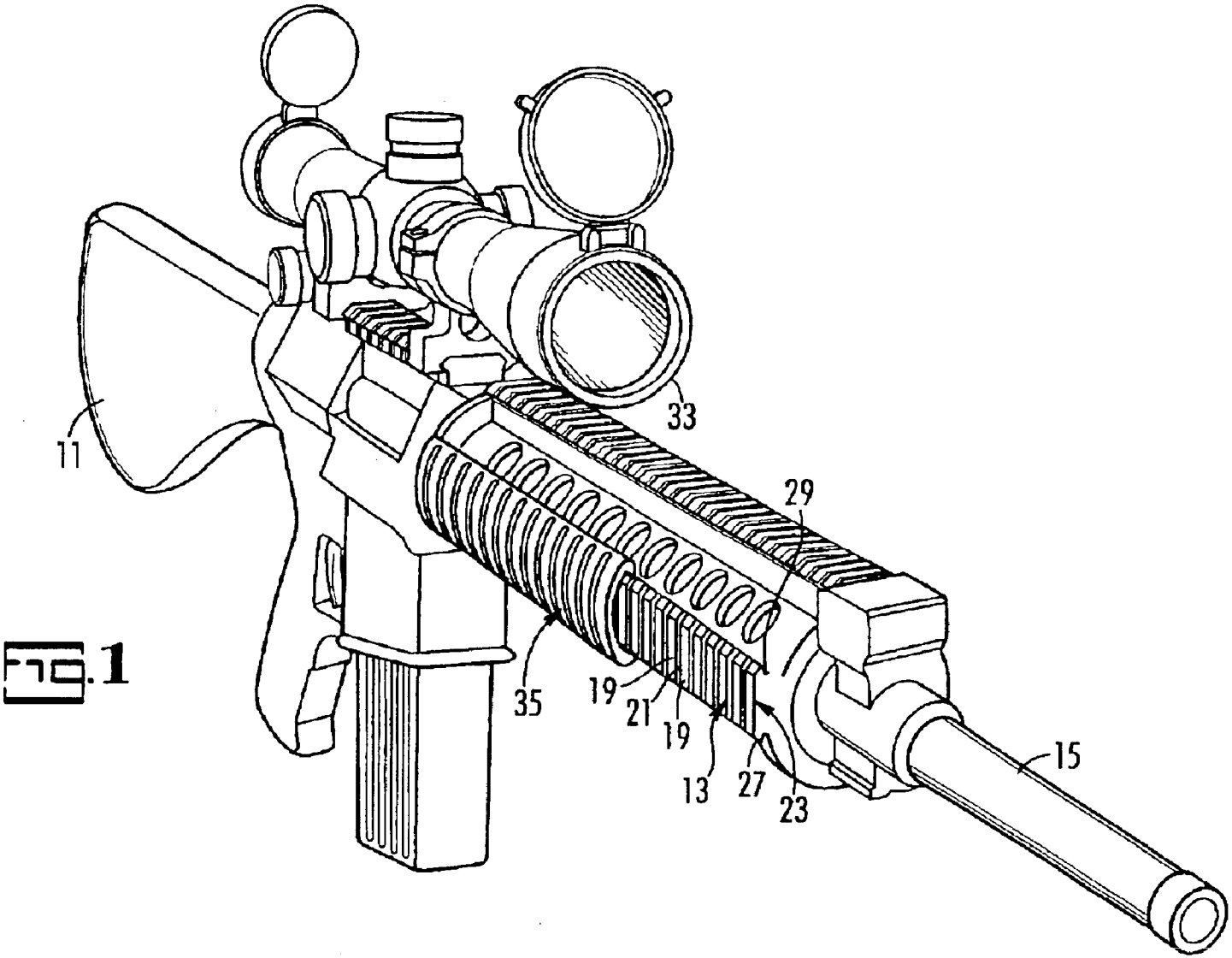
FIG. 1 is a perspective view of rifle with a Picatinny rail and a rail cover thereon, according to a preferred embodiment of the present invention.

Referring to FIG. 1, the weapon system 11 has a Picatinny rail 13. Rail 13 is either a part of weapon system 11 or it may be part of an attachment such as a universal rail for enabling the weapon system 11 to carry additional weapons and weapon-related devices. There may be several rails 13 on a single weapon system 11, such as one along the top and one on each side of a barrel 15 of weapon system 11.

Picatinny rail 13 is defined as a surface provided for the attachment of weapons and weapons system having a series of alternating teeth 19 and grooves 21. Rail 13 has a cross section that is hexagonal with two sides, namely the top and the bottom of the hexagon, being longer than the other two sides. Teeth 19 and grooves 21 are formed in the top surface 23, as shown in FIG. 1. Each of the two pair of side surfaces define a corner, one of which can arbitrarily be called the leading corner 27 and the other the trailing corner 31. Because Picatinny rails are common in military weaponry as a surface for attaching scopes and spotters, for example, from many manufacturers, the Picatinny rail is a well-known, well-defined device.

A universal mount is a device that can be attached to a rifle or other weapon to provide it with a Picatinny rail so that scopes, spotters and so on, may be attached to it along the top or sides. A universal mount usually attaches to barrel 15. An example of a universal mount is provided in U.S. Pat. No. 5,590,484, which is incorporated herein in its entirety by reference.

Figure 2:
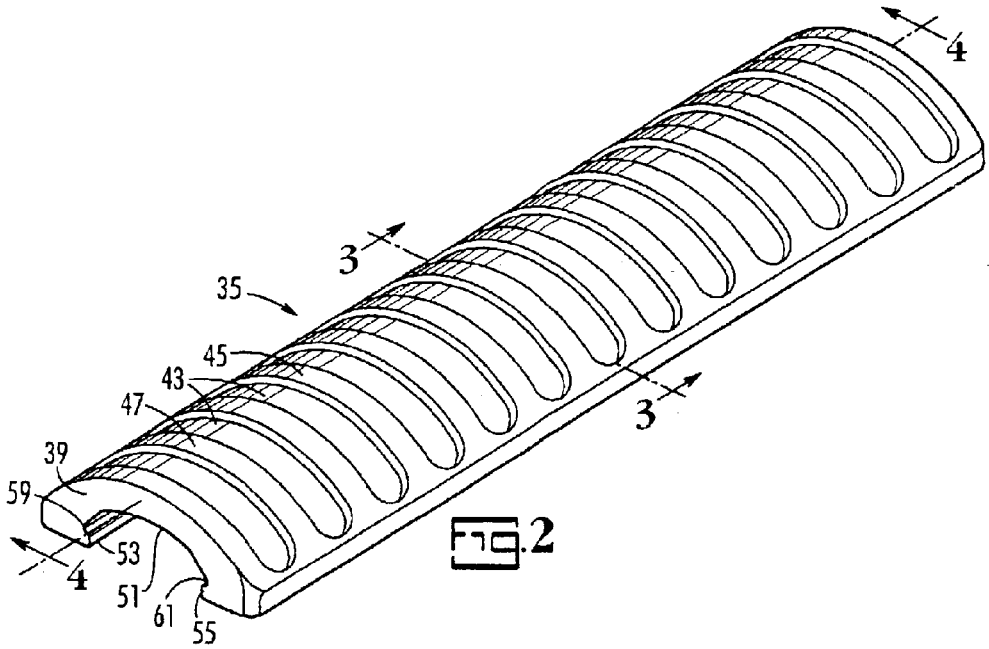
FIG. 2 is a perspective view of a rail cover according to a preferred embodiment of the present invention.
Figure 3:
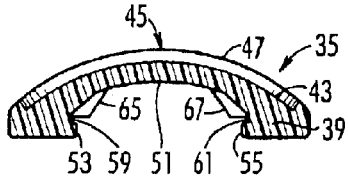
FIG. 3 is a cross sectional view taken along lines 3—3 of FIG. 2.
Figure 4:
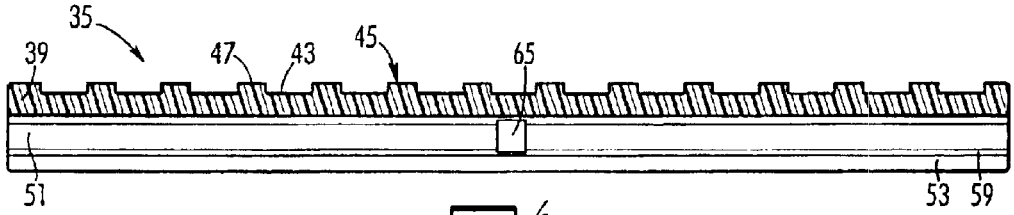
FIG. 4 is a cross sectional view taken along lines 4—4 of FIG. 2

In FIG. 1, weapon system 11 is shown carrying rail 13 to which is mounted scope 33, but any number of different accessories may be mounted to rail 13 in a manner convenient to the user. FIG. 1 also shows a rail cover 35, according to a preferred embodiment of the present invention. Rail cover 35 is a single piece of molded polymer, as shown in FIGS. 2–4. It comprises a generally arcuate body 39, defining a portion of a right cylinder, with a series of grooves 43 formed in its convex, outer surface 45, leaving material between grooves 43 that define a series of ribs 47. Grooves 43 and ribs 47 run transverse to the long dimension of rail cover 35 and generally follow the arc of body 39. Grooves 43 and ribs 47 provide outside surface 45 with texture to increase the user's ability to grip weapon system 11, but they also have other functions that will shortly be explained.

The opposing, inner surface 51 of body 39 is generally concave except for two opposing rail grips, a leading rail grip 53 and a trailing rail grip 55. Inner surface 51 is dimensioned to be slightly larger than rail 13 so that rail 13 can fit within inner surface 51. Leading and trailing rail grips 53, 55, run the length of inner surface 51 of body 39 and extend slightly inward from the balance of inner surface 51, defining channels 59 and 61. The purpose of leading and trailing rail grips 53, 55, is to act as clamping points, holding rail 13 in engagement with inner surface 51 of body 39.

Along leading and trailing surfaces 53, 55, slightly separated from them and integral with inner surface 51 are locking tabs 63, 65, that are formed to fit between two adjacent teeth 19 and into one groove 21 of Picatinny rail 13. Locking tabs 63, 65, prevent the axial movement of body 39 when rail cover 35 is installed on Picatinny rail 13.

Rail cover 35 is dimensioned and designed to snap onto Picatinny rail 13 rather than be slid onto a rail 13 from its end. In order to apply rail cover 35, leading edge 53 of body 39 is placed adjacent to leading corner 27 of Picatinny rail 13, then, body 39 is rotated against rail 13. By applying direct pressure normal to outer surface 45, trailing rail grip 55 is forced to spread apart from leading rail grip 53 allowing trailing rail grip 55 to snap over trailing corner of rail 13 and body 39 thus captures both corners 27, 29, in channels 59, 61, behind leading and trailing rail grips 53, 55. Also locking tabs 63, 65, enter grooves 21 between adjacent teeth 19 of rail 13 to prevent axial movement of body 39.

In the attached position, rail cover 35, acts as a grip or fore-stock that may be used to grip weapon system 11 providing comfort and control for the user. At the same time, rail cover 35 protects the user from the edges of teeth 19 on rail 13 and the heat of barrel 15 during repeated firing of weapon system 11. The user may attach rail cover 35 to any convenient positioned on rail 13.

In the installed position, the distance between rail grips 53, 55, is not as much as the distance needed to pass over rail 13, but it is greater than the distance between rail grips 53, 55, when rail cover 35 is not installed. In the installed position, rail cover 35 acts like a "C" clamp that grabs rail 13 because of the spring force created by the forced open "C" clamp and the elastic material of rail cover 35. The spring force clamps rail 13 so that rail cover 35 will not fall off during normal use, which includes shocks from drop impacts, temperature changes due to firing and various environmental conditions, and cyclical recoil impacts. The ability of rail cover 35 to withstand such use is aided by strength ribs 47.

Removal of rail cover 35 is easily accomplished by lifting one corner of body 39 along either leading rail grip 53 or trailing rail grip 55. Lifting one corner starts to spread leading and trailing rail grip 53, 55, from each other. Once a leading rail grip 53, for example, is lifted far enough, leading rail grip 53 will begin to clear leading corner 27 beginning at one end of body 39 and continuing to the other end of body 39 along the same side. Once one side of rail cover 35 is clear of leading corner 27, body 39 will slide off rail 13 altogether.

Rail cover 35, is thus removed by the user with a twisting action coupled with a pulling motion perpendicular to the surface of rail 13. The removal and installation forces are a function of the material used in combination with the dimensional arrangement of grooves 43 and ribs 45. In the preferred embodiment, grooves 43 and ribs 45 will be dimensioned to achieve removal and installation forces as specifications require, but it is foreseeable that grooves 43 and ribs 45 could have other shapes as required to achieve specific performance requirements, including comfort.

To provide the flexibility but, at the same time, strength and dimensional stability for rail cover 35, it is preferably made of a slightly flexible but tough material, such as a polymer with a rubberizing agent added. This material resists abrasion and dimensional changes from age and temperature. In addition to the type of material of which body 39 is made, the removal of material to form grooves 43 and ribs 47 increases flexibility but at minor loss of strength.

Rail cover 35 and its components—body 39, leading and trailing rail grips 53, 55, and locking tabs 63, 65—are preferably integrally molded. In the preferred embodiment, the exact dimensions of rail cover 35 components such as locking tabs 63, 65, rail grips 53, 55, grooves 43, and ribs 45 are also influenced by fluid flow characteristics of the molten material as it flows in the mold, and potential dimensional changes due to post-molding cooling effects. The rail cover 35 is symmetric front to back, left to right, so that rail cover 17 may be attached to rail 13 in either direction.

Figure 5:
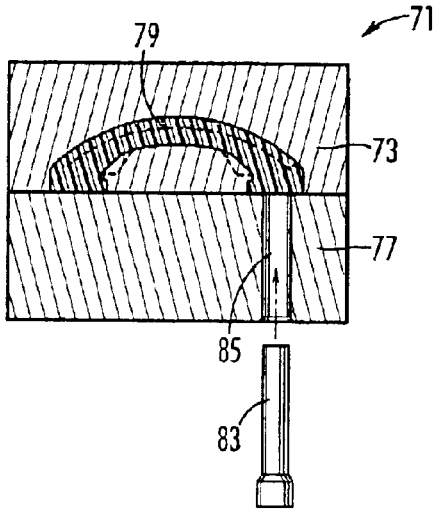
FIG. 5 illustrates the present rail cover being molded.
Figure 6:
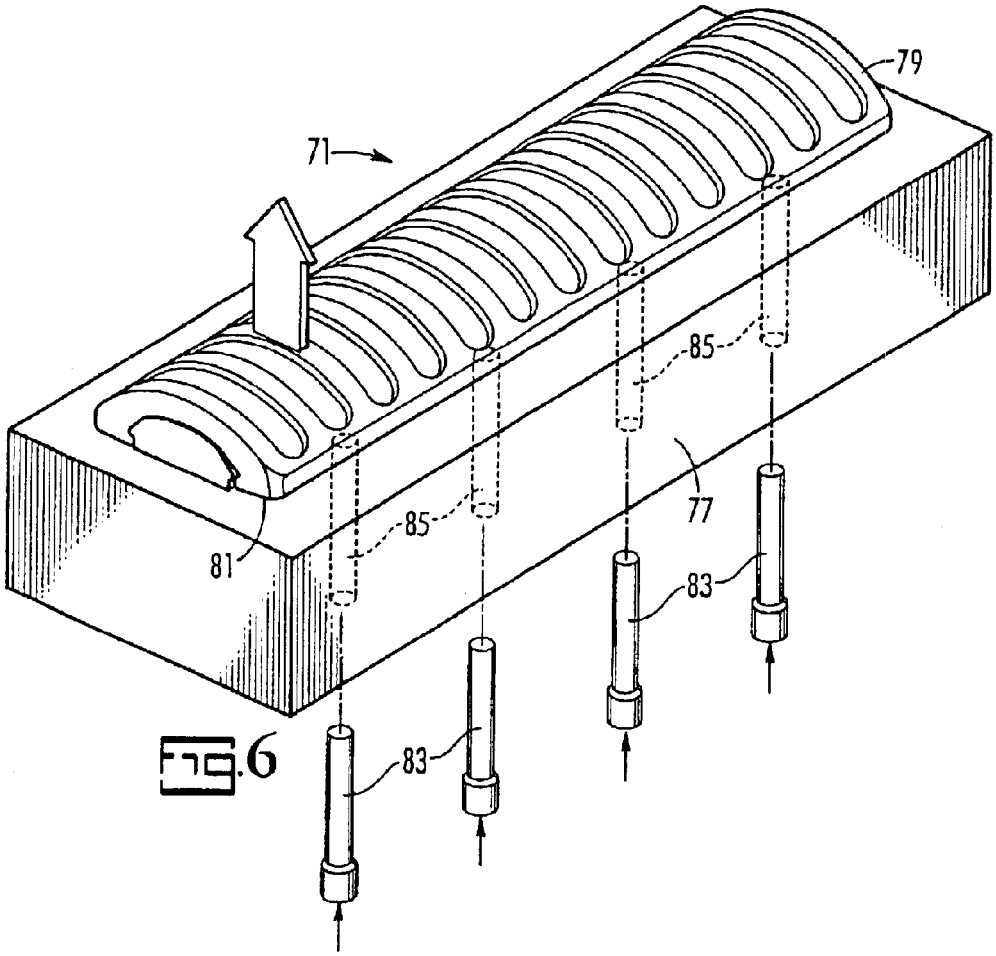
FIG. 6 illustrates the present rail cover being removed from the mold.

Not only is rail cover 35 dimensioned with final performance specifications in mind, but it is also dimensioned to achieve optimum performance during the molding and manufacturing process. In molding, as shown in FIGS. 5 and 6, the mold 71 has an upper part 73 and a lower part 77. The molding composition is put into mold 71 and allowed to cure. The upper part 73 is lifted clear of the molded rail cover 79 and a surface 81 of rail cover 79 is lifted or pushed upward to free rail cover from lower part 77. Rail grips 53, 55 (FIG. 3), enable rail cover 79 to grab rail 13 (FIG. 1) with appropriate force during use but also facilitate removal from the mold during manufacturing. A simple set of ejector pins 83 operating against surface 81 of rail cover 79 through holes 85 in lower part 77 can remove the finished rail cover 79, or alternatively robotic arms may also be used to remove rail cover 79 from mold 71. The use of the clamping feature of rail grips 53, 55, also as a part molding retention feature provides for economy of material and tooling, which avoids the need for a complicated part ejection system or slides. Rail cover 79 may be ejected from mold 71 without excessive force, possibly while still warm. Locking tabs 65, 67 (not shown in FIGS. 5 and 6), are also dimensioned to allow for easy ejection from mold 71.

It will be apparent to those skilled in the art of designing and manufacturing of weapons components that many modifications and substitutions can be made to the foregoing described embodiments without departing from the spirit and scope of the present invention, defined by the appended claims.

What is claimed is:

1. A rail cover, comprising:

an arcuate body having a convexly curved outer surface and a concavely curved inner surface;

a leading rail grip carried by said inner surface;

a trailing rail grip carried by said inner surface, said trailing rail grip being spaced apart from said leading rail grip;

a first locking tab carried by said inner surface and spaced apart from said leading rail grip; and a second locking tab carried by said inner surface and spaced apart from said trailing rail grip, wherein said inner surface is dimensioned to receive a Picatinny rail between said leading rail grid and said trailing rail grip and wherein said Picatinny rail has an alternating series of teeth and grooves, and wherein said first and second locking tabs fit into any groove of said Picatinny rail.

2. The rail cover as recited in claim 1, wherein said first and said second locking tabs are integral with said body.

3. The rail cover as recited in claim 1, wherein said body is made of a composition including polymer.

4. The rail cover as recited in claim 3, wherein said composition includes a rubberizing agent.

5. The rail cover as recited in claim 1, wherein said outer surface carries means for increasing flexibility of said body.

6. The rail cover as recited in claim 1, wherein said outer surface carries means for increasing a user's grip on body.

7. The rail cover as recited in claim 1, wherein said outer surface has a series of grooves formed therein.

8. A device for use with a rifle, said device comprising:

a universal mount having at least one Picatinny rail, said at least one Picatinny rail having an alternating series of teeth and grooves; and at least one hand grip carried by said Picatinny rail, said hand grip having an arcuate body having a convexly curved outer surface and a concavely curved inner surface, a leading rail grip carried by said inner surface, a trailing rail grip carried by said inner surface, said trailing rail grip being spaced apart from said leading rail grip so that said Picatinny rail is receivable within said inner surface between said leading rail grip and said trailing rail grip, a first locking tab carried by said inner surface and spaced apart from said leading rail grip, and a second locking tab carried by said inner surface and spaced apart from said trailing rail grip, said first and said second locking tabs being dimensioned to fit into any groove of said Picatinny rail.

9. The device as recited in claim 8, wherein said outer surface of said body has a series of grooves formed therein.

10. A rail cover, comprising:

an arcuate body having a concavely curved inner surface;

a leading rail grip carried by said inner surface;

a trailing rail grip carried by said inner surface, said trailing rail grip being spaced apart from said leading rail grip; and a locking tab carried by said inner surface and spaced apart from said leading rail grip wherein said inner surface is dimensioned to receive a Picatinny rail between said leading rail grip and said trailing rail grip and wherein said Picatinny rail has an alternating series of teeth and grooves, and wherein said locking tab fits into any groove of said Picatinny rail.

11. The rail cover as recited in claim 10, wherein said locking tab is integral with said body.

12. The rail cover as recited in claim 10, wherein said body is made of a composition including polymer.

13. The rail cover as recited in claim 12, wherein said composition includes a rubberized agent.

* * * * *